US011066820B1

(12) United States Patent
Yang

(10) Patent No.: US 11,066,820 B1
(45) Date of Patent: Jul. 20, 2021

(54) UNIVERSAL NON-CONVEX PRESS TYPE DRAIN

(71) Applicant: Mei-Li Yang, New Taipei (TW)

(72) Inventor: Mei-Li Yang, New Taipei (TW)

( * ) Notice: Subject to any disclaimer, the term of this patent is extended or adjusted under 35 U.S.C. 154(b) by 0 days.

(21) Appl. No.: 16/892,610

(22) Filed: Jun. 4, 2020

(51) Int. Cl.
*E03C 1/262* (2006.01)

(52) U.S. Cl.
CPC ..... *E03C 1/262* (2013.01)

(58) Field of Classification Search
CPC . E03C 1/26; E03C 1/262; E03C 1/264; E03C 1/28; E03C 1/282
See application file for complete search history.

(56) References Cited

U.S. PATENT DOCUMENTS 7,013,500 B1 * 3/2006 Lin ..... E03C 1/262 4/287
9,038,661 B2 * 5/2015 Lin ..... E03F 5/0407 137/532

* cited by examiner

*Primary Examiner* — Janie M Loeppke
(74) *Attorney, Agent, or Firm* — Rosenberg, Klein & Lee

(57) ABSTRACT

A universal non-convex press type drain, comprising: a drainpipe, having an upper stop section and a lower stop section; a pressing drain arranged inside the drainpipe and positioned by the lower stop section, the pressing drain has a stopper for stopping and draining water, the rise and fall of the stopper can be control by pressing; and a moveable strainer, the moveable strainer has a compression spring and has a pressing block below the moveable strainer; when the moveable strainer is not pressed, the compression spring makes the top edge of the moveable strainer aligned to the top edge of the drainpipe. So as to provide a non-convex press type drain which top edge is aligned to the installed surface and has the effect of preventing smell and insect.

5 Claims, 6 Drawing Sheets

UNIVERSAL NON-CONVEX PRESS TYPE DRAIN

BACKGROUND OF THE INVENTION

1. Field of the Invention

The invention relates to a universal non-convex press type drain, especially to one that has a moveable strainer aligned to the top edge of the drainpipe and switching the drain mode or stop mode of the drain by pressing the moveable strainer.

2. Description of the Related Art

Bath tub, washbasin, the bathroom floor and the toilet is a common appliances and place which need draining design, wherein the toile is designed with a trap for preventing smell, dangerous gases, and insects; however, most of the floor drains are not having a trap, so the smell or insects may come out from the pipe; moreover, the conventional bath tub drain or washbasin drain is convex, although the drain can prevent smell or insects, some problems are common happened to user, such as kicking the convex part or hands being cutting by the convex part of the drain and caused injured.

SUMMARY OF THE INVENTION

It is a primary objective of the present invention to provide a universal non-convex press type drain and having a flat strainer aligned to the installing surface for preventing smell, dangerous gases, and insects.

It is another objective of the present invention to provide a universal non-convex press type drain that can applied to all specification of bathtub, washbasin, the bathroom floor.

In order to achieve the above objectives, the universal non-convex press type drain includes a drainpipe, which is a step shape with internal shrinkage and having an upper stop section and a lower stop section on the inner edge of the pipe; a pressing drain arranged inside the drainpipe and supported and positioned by the lower stop section, the pressing drain has a stopper for stopping and draining water, the rise and fall of the stopper can be control by pressing; and a moveable strainer corresponding to the size of the top of the drainpipe arranged inside the drainpipe, the moveable strainer has a compression spring arranged between the upper stop section and the bottom of the moveable strainer and has a pressing block below the moveable strainer; when the moveable strainer is not pressed, the compression spring makes the top edge of the moveable strainer aligned to the top edge of the drainpipe, and makes the bottom edge of the pressing block against the top edge of the stopper which is on drain mode; wherein the top of the drainpipe has an outward convex ring.

Moreover, the pressing block has a longitudinal through hole, the longitudinal through hole has an internal shrinkage stop part, and having a sinking column arranged in the longitudinal through hole, on the top edge of the sinking column has an engaging ring element corresponding to the stop part, and the bottom edge of the sinking column is connected to the top of the stopper, therefore, when the stopper is rising during drain mode, the sinking column is also rising to be seen, and when the stopper is sinking during stop mode, the sinking column is also sinking to be hidden, so the position of the sinking column can let the user knows whether the stopper is in drain mode or stop mode.

Also, the pressing drain includes: the stopper, a base, an elevating component, a rotor, a jacking spring, a sealing ring, and a sealing gasket; the base has an inner tube and a ring body, between the inner tube and the ring body has multiple arms and further forms an engaging space, the base is secured by the ring body on the lower stop section; the jacking spring, the rotor and the elevating component are arranged inside the inner tube, the sealing ring is connecting to the open end of the inner tube, and combining the inner tube, the elevating component, the rotor, the jacking spring and the sealing ring to form a press type elevating mechanism, wherein the stopper is connected to the elevating component, and the sealing gasket is arranged on the outer periphery of the stopper; wherein the outer periphery of the ring body further has a o-ring; the bottom of the inner tube is a one-piece structure, and the top end of the inner body is considered as the open end.

Whereby normally the moveable strainer is aligned to the top edge of the drainpipe, when the moveable strainer is under pressure, the pressing block pushes the stopper to actuate the drain mode or stop mode, after the pressure is released, the return of the compression spring makes the moveable strainer aligned to the top edge of the drainpipe again.

DETAILED DESCRIPTION OF THE PREFERRED EMBODIMENT

Figure 1:
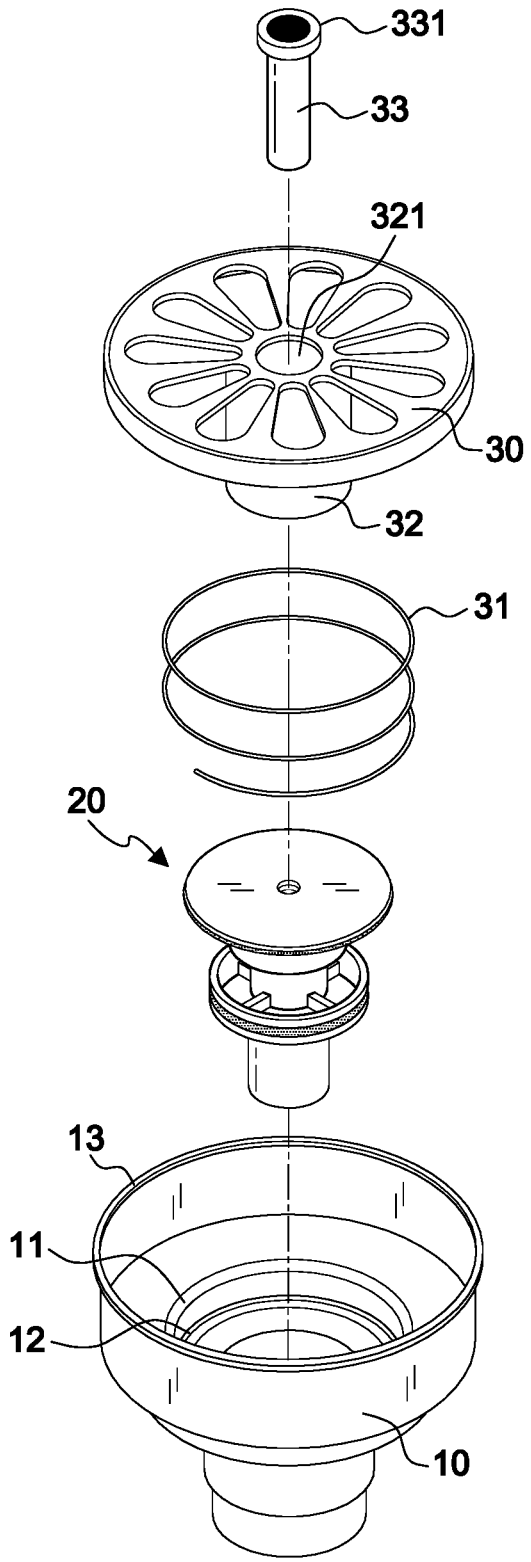
FIG. 1 is an exploded perspective views of the present invention.
Figure 2:
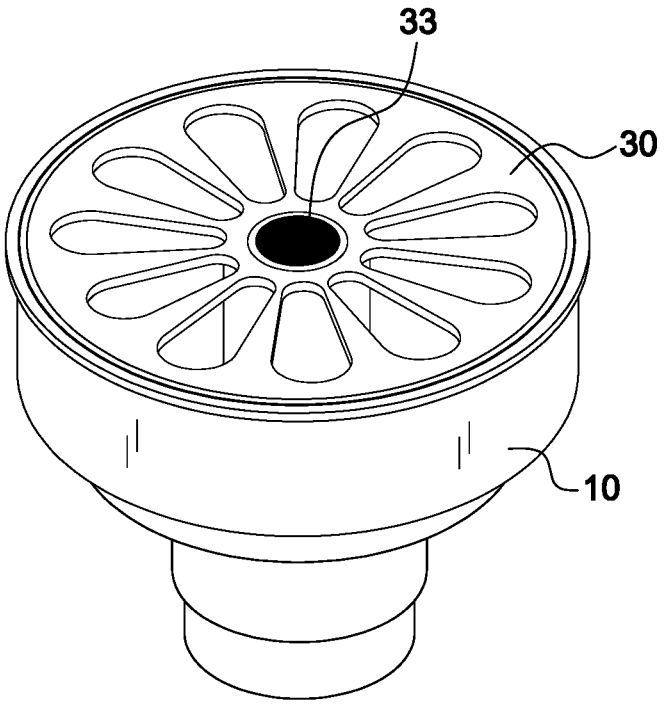
FIG. 2 an assembly perspective views of the present invention.

Referring to FIGS. 1-6, the present invention mainly includes: a drainpipe 10, which is a step shape with internal shrinkage and having an upper stop section 11 and a lower stop section 12 on the inner edge of the pipe, the top of the drainpipe 10 has an outward convex ring 13;

a pressing drain 20 arranged inside the drainpipe 10 and supported and positioned by the lower stop section 12, the pressing drain 20 has a stopper 21 for stopping and draining water, the rise and fall of the stopper 21 can be control by pressing; and a moveable strainer 30 corresponding to the size of the top of the drainpipe 10 arranged inside the drainpipe 10, the moveable strainer 30 has a compression spring 31 arranged between the upper stop section 11 and the bottom of the moveable strainer 30 and has a pressing block 32 below the moveable strainer 30; when the moveable strainer 30 is not pressed, the compression spring 31 makes the top edge of the moveable strainer 30 aligned to the top edge of the drainpipe 10, and makes the bottom edge of the pressing block 32 against the top edge of the stopper 21 which is on drain mode; moreover, the pressing block 32 has a longitudinal through hole 321, the longitudinal through hole 321 has an internal shrinkage stop part 322, and having a sinking column 33 arranged in the longitudinal through hole 321, on the top edge of the sinking column 33 has an engaging ring element 331 corresponding to the stop part 322, and the bottom edge of the sinking column 33 is connected to the top of the stopper 21.

Figure 3:
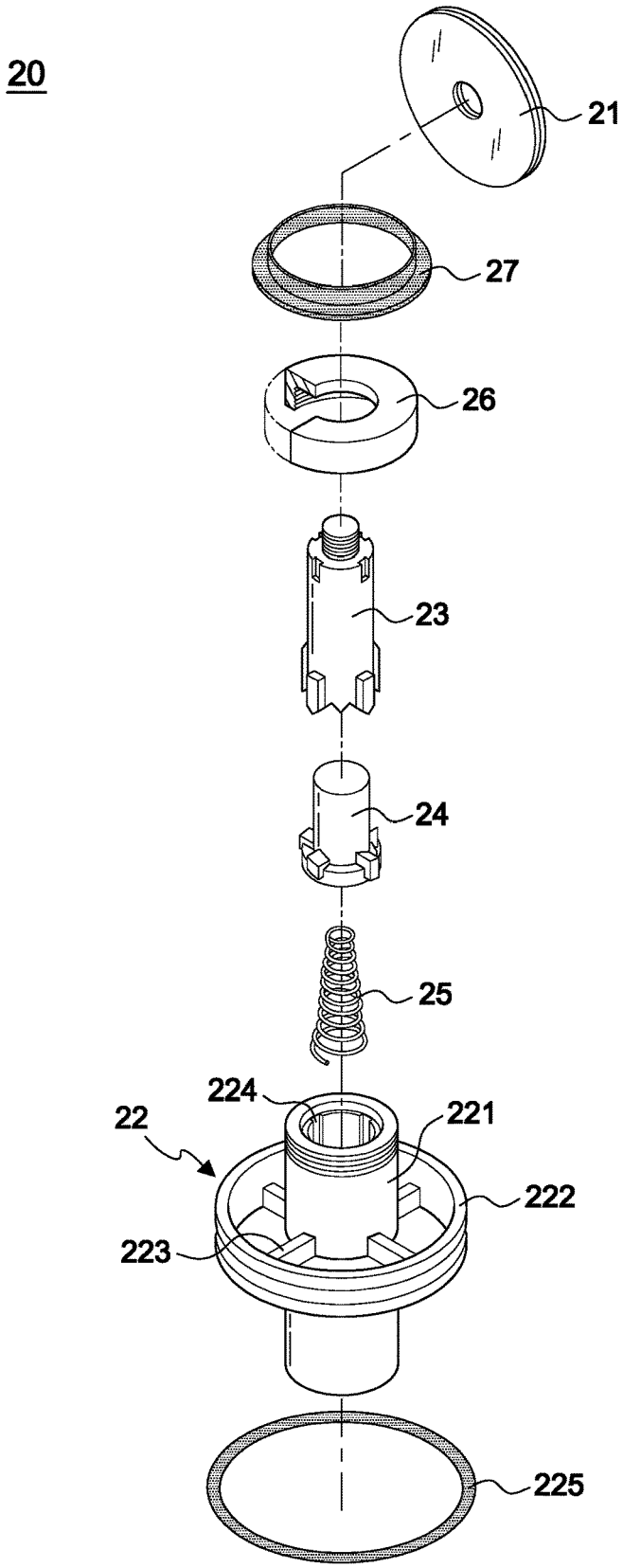
FIG. 3 is an exploded perspective views of the pressing drain of the present invention.

Moreover, referring to FIG. 3, the pressing drain includes: the stopper 21, a base 22, an elevating component 23, a rotor 24, a jacking spring 25, a sealing ring 26, and a sealing gasket 27; wherein, the base 22 has an inner tube 221 and a ring body 222, between the inner tube 221 and the ring body 222 has multiple arms 223 and further forms an engaging space 224, the base 22 is secured by the ring body 222 on the lower stop section 12, the outer periphery of the ring body 222 further has a o-ring 225; the jacking spring 25, the rotor 24 and the elevating component 23 are arranged inside the inner tube 221, the sealing ring 26 is connecting to the open end of the inner tube 221, the top end of the inner tube 221 is considered as the open end (the inner tube 221 is an one-piece structure), and combining the inner tube 221, the elevating component 23, the rotor 24, the jacking spring 25 and the sealing ring 26 to form a press type elevating mechanism, wherein the stopper 21 is connected to the elevating component 23, and the sealing gasket 27 is arranged on the outer periphery of the stopper 21.

Figure 4:
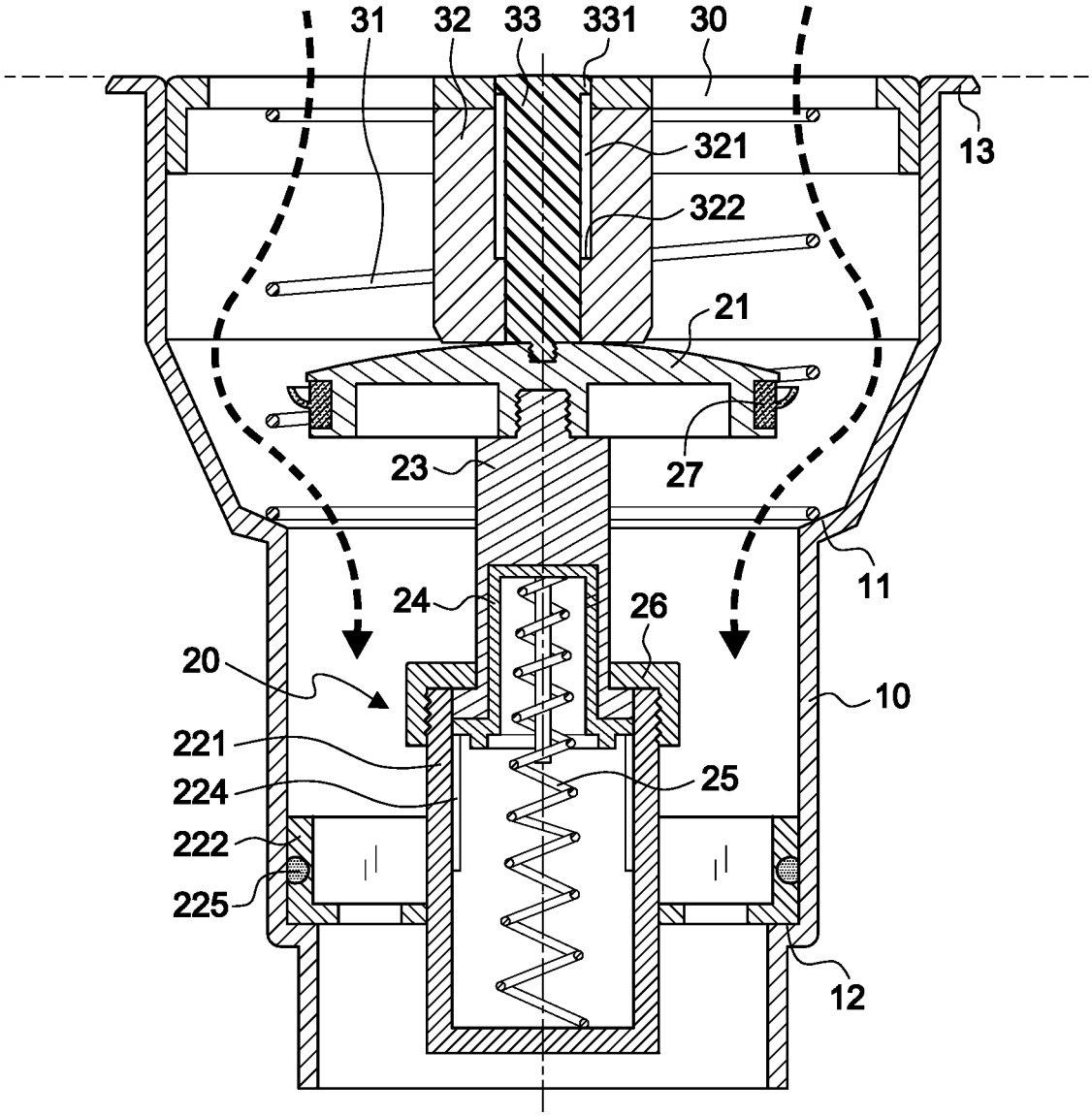
FIG. 4 is a sectional view of the present invention in the drain mode.
Figure 5:
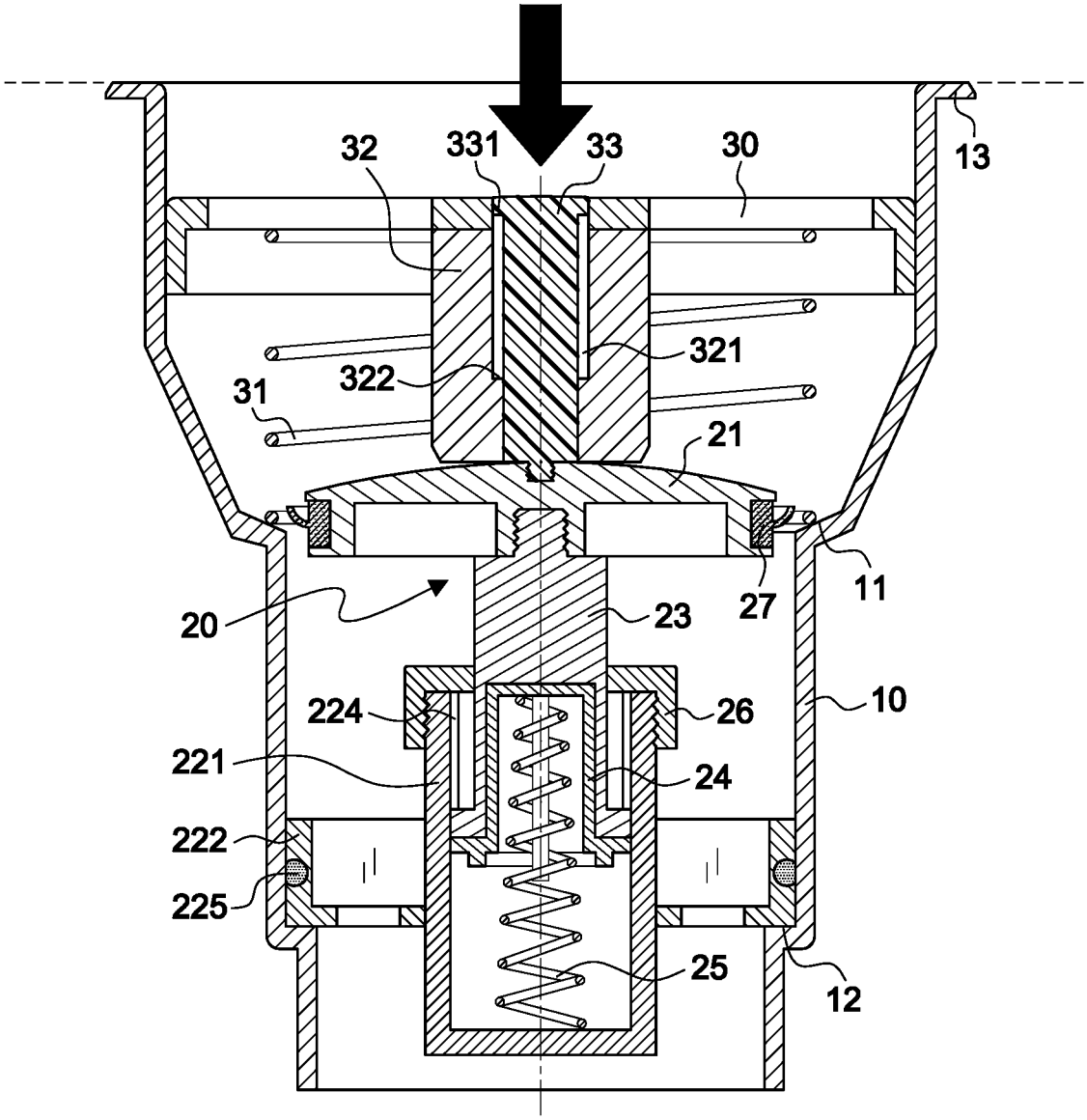
FIG. 5 is a sectional view of the present invention during pressing the moveable strainer.
Figure 6:
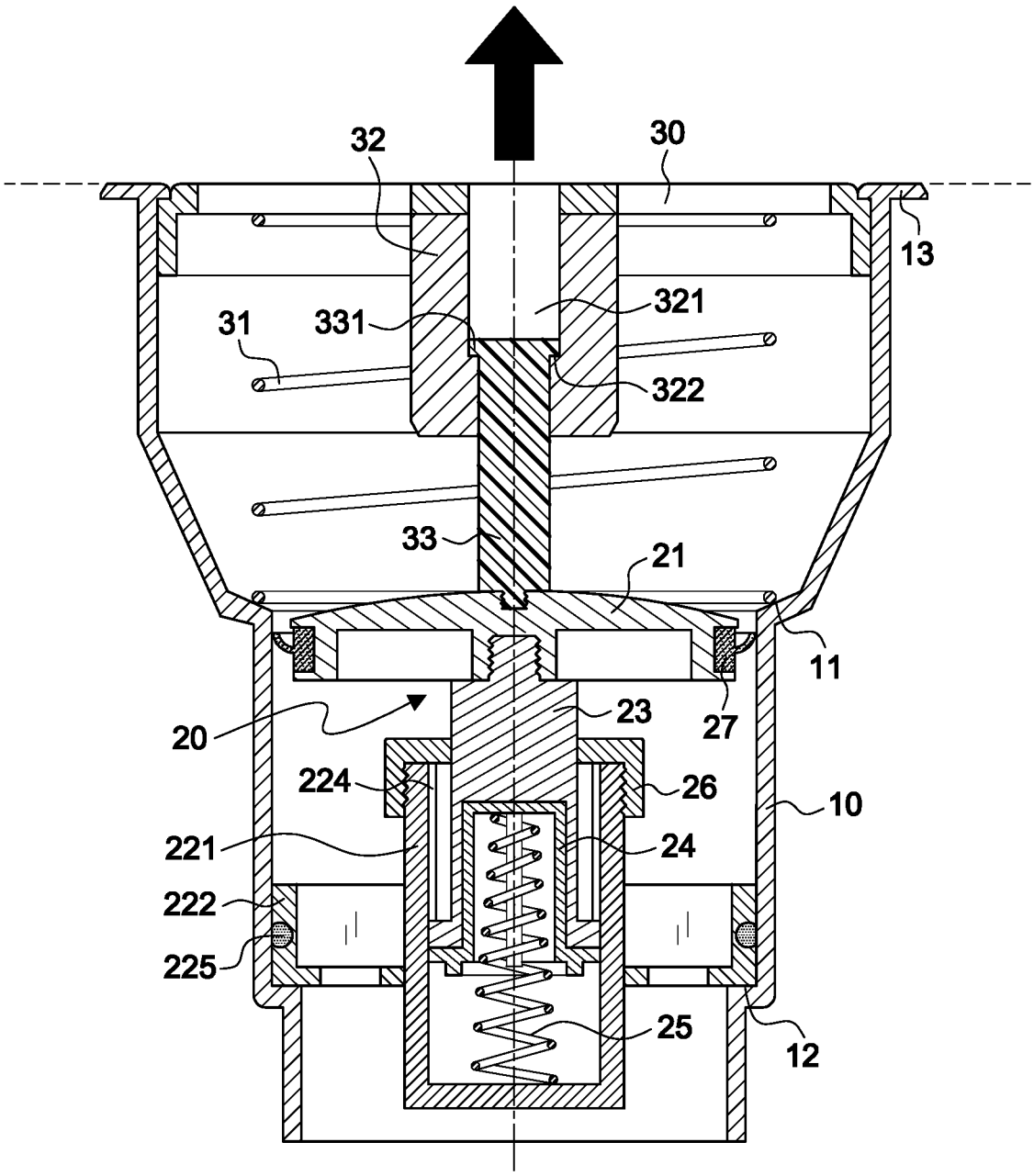
FIG. 6 is a sectional view of the present invention in the stop mode.

Also, referring to FIGS. 4-6, normally the moveable strainer 30 is aligned to the top edge of the drainpipe 10, when the moveable strainer 30 is under pressure, the pressing block 32 pushes the stopper 21 to actuate the drain mode or stop mode, after the pressure is released, the return of the compression spring 31 makes the moveable strainer 30 aligned to the top edge of the drainpipe 10 again; however, when the stopper 21 is rising during drain mode, the sinking column 33 is also rising to be seen (as FIG. 4 showing), and when the stopper 21 is sinking during stop mode, the sinking column 33 is also sinking to be hidden (as FIG. 6 showing), so the position of the sinking column 33 can let the user knows whether the stopper 21 is in drain mode or stop mode.

Therefore, the present invention masterly combines the pressing drain 20 and the moveable strainer 30, the present invention is fit for bathtub, washbasin, and the bathroom floor, by pressing the moveable strainer 30, the user can switch the drain mode or stop mode of the pressing drain 20, during the stop mode, the pressing drain 20 can further prevent the smell and the insect; moreover, when the down pressure applied on the moveable strainer 30 is released, the return of the compression spring 31 makes the top edge of the moveable strainer 30 aligned to the top edge of the drainpipe 10 (not convex), so when the present invention is applied to the washbasin, there is no convex part which may cut user's hand, and when it is applied to the floor and bathtub, there is no convex part may be kicked by user; also, the pressing drain 20 and the moveable strainer 30 can further install a hair strainer, since the pressing drain 20 and the moveable strainer 30 are easy to uninstall and install, the present invention can improve the convenience of removing hair or any stuff which stuck in the drain.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A universal non-convex press type drain, comprising:

a drainpipe, which is a step shape with internal shrinkage and having an upper stop section and a lower stop section on a inner edge of a pipe;

a pressing drain arranged inside the drainpipe and supported and positioned by the lower stop section, the pressing drain has a stopper for stopping and draining water, the rise and fall of the stopper can be controlled by pressing; and a moveable strainer corresponding to a size of a top of the drainpipe arranged inside the drainpipe, the moveable strainer has a compression spring arranged between the upper stop section and a bottom of the moveable strainer and has a pressing block below the moveable strainer; when the moveable strainer is not pressed, the compression spring makes a top edge of the moveable strainer aligned to a top edge of the drainpipe, and makes a bottom edge of the pressing block against atop edge of the stopper which is on drain mode;

whereby normally the moveable strainer is aligned to the top edge of the drainpipe, when the moveable strainer is under pressure, the pressing block pushes the stopper to actuate the drain mode or stop mode, after the pressure is released, the return of the compression spring makes the moveable strainer aligned to the top edge of the drainpipe again.

2. The universal non-convex press type drain as claimed in claim 1, wherein the pressing block has a longitudinal through hole, the longitudinal through hole has an internal shrinkage stop part, and having a sinking column arranged in the longitudinal through hole, a top edge of the sinking column has an engaging ring element corresponding to the stop part, and a bottom edge of the sinking column is connected to a top of the stopper, therefore, when the stopper is rising during drain mode, the sinking column is also rising to be seen, and when the stopper is sinking during stop mode, the sinking column is also sinking to be hidden, so the position of the sinking column can let a user know whether the stopper is in drain mode or stop mode.

3. The universal non-convex press type drain as claimed in claim 2, wherein the pressing drain includes: the stopper, a base, an elevating component, a rotor, a jacking spring, a sealing ring, and a sealing gasket; the base has an inner tube and a ring body, between the inner tube and the ring body has multiple arms and further forms an engaging space, the base is secured by the ring body on the lower stop section; the jacking spring, the rotor and the elevating component are arranged inside the inner tube, the sealing ring is connecting to an open end of the inner tube, and combining the inner tube, the elevating component, the rotor, the jacking spring and the sealing ring to form a press type elevating mechanism, wherein the stopper is connected to the elevating component, and the sealing gasket is arranged on an outer periphery of the stopper.

4. The universal non-convex press type drain as claimed in claim 3, wherein the outer periphery of the ring body further has a o-ring; a bottom of the inner tube is a one-piece structure, and a top end of the inner tube is considered as the open end.

5. The universal non-convex press type drain as claimed in claim 4, wherein the top of the drainpipe has an outward convex ring.

* * * * *